United States Patent [19]

Anderson et al.

[11] 4,195,460

[45] Apr. 1, 1980

[54] INSULATED ROOF PANEL

[75] Inventors: John W. Anderson, Bradford Woods; Robert G. Lindner, Sewickley, both of Pa.

[73] Assignee: H. H. Robertson Company, Pittsburgh, Pa.

[21] Appl. No.: 932,359

[22] Filed: Aug. 9, 1978

[30] Foreign Application Priority Data

Aug. 27, 1977 [ES] Spain ..... 230.626

[51] Int. Cl.[2] ..... E04D 3/362; E04D 3/35

[52] U.S. Cl. ..... 52/528; 52/309.9; 52/588

[58] Field of Search ..... 52/528, 309.9, 542, 52/588, 595, 536, 538, 539, 540, 478, 489

[56] References Cited

U.S. PATENT DOCUMENTS

| | | | |
|---|---|---|---|
| 2,003,728 | 6/1935 | Forster et al. | 52/528 X |
| 2,910,150 | 10/1959 | Roseman | 52/588 X |
| 3,127,962 | 4/1964 | James | 52/588 |
| 3,462,906 | 8/1969 | Schroyer | 52/478 |
| 3,511,011 | 5/1970 | Straus | 52/489 X |
| 3,555,758 | 1/1971 | Schroter | 52/309.9 |
| 3,667,180 | 6/1972 | Tischuk | 52/309.9 X |
| 3,708,943 | 1/1973 | Thomas et al. | 52/478 X |
| 3,777,430 | 12/1973 | Tischuk | 52/309.9 |

*Primary Examiner*—Stephen J. Novosad

*Attorney, Agent, or Firm*—Harry B. Keck; George E. Manias

[57] ABSTRACT

A composite roof panel comprising inner and outer skins which are connected in shear-transferring relation by an insulating core. The outer skin presents marginal connecting means, a first of which is adapted to receive and to be bent, i.e., closed, about a second connecting means of an adjacent panel to provide a standing seam connection at the exterior face of the roof structure. During closure, the first connecting means is bent in one direction and experiences only minor bending stresses. Hence, a large number of different types of decorative coating materials can be applied to the outer skin. The inner skin presents complementary mating elements which provide a connection between adjacent panels at the interior face of the roof structure. Means adapting the panel to be erected in end-to-end overlapped relation and in side-by-side interlocked relation is disclosed.

7 Claims, 4 Drawing Figures

INSULATED ROOF PANEL

BACKGROUND OF THE INVENTION

1. Field of the Invention

This invention concerns insulated panels of the type adapted to be assembled in side-by-side interlocked relation and secured to a building framework to provide a roof structure.

2. Description of the Prior Art

Insulated roof panels presenting interfitted connecting elements one or both of which are adapted to be deformed to provide a standing seam connection are known in the art. See for example U.S. Pat. No. 3,555,758 (Schroter) and French Pat. No. 70.24971 (Glaros).

The female connector of the Schroter panel requires outward splaying during interfitting of the male connector therein and inward deformation during closure. The double deflection may introduce undesirable cracking and spalling of an exterior decorative coating. Hence, only a limited number of different types of decorative coatings may be applied to the Schroter panel.

The interfitted connecting elements of the Glaros panel experience severe, and hence undesirable, bending stresses during closure.

SUMMARY OF THE INVENTION

The principal object of the invention is to provide a composite roof panel having complementary mating elements providing a connection between adjacent panels at the interior face of the roof structure, and having marginal connecting means providing a standing seam connection between adjacent panels at the exterior face of the roof structure for the purpose of improving the watertightness, thermal insulation and sound insulation of the roof structure.

The present insulated composite roof panel is of the type comprising an inner skin, an outer skin, and an insulating core connecting the inner skin in shear-transferring relation to the outer skin. The present roof panel is characterized in that the inner skin includes a central inner web and complementary mating elements, such as a tongue and a groove formed along the opposite longitudinal edges of the inner web.

The roof panel is further characterized in that the outer skin includes first and second marginal connecting means formed along the upper edges of sidewalls which extend upwardlly from the opposite longitudinal edges of the outer skin. The second connecting means is adapted to receive and to be bent about the generally tubular rib of an adjacent panel thereby to provide a watertight joint.

The roof panel is further characterized in that the inner and outer skins and the insulating core are conterminous at a first end of the panel, while at the opposite or second end of the panel, the outer skin extends beyond the inner skin of the insulating core to provide a lapping end, whereby the present roof panels may be assembled in end-to-end overlapped relation.

The roof panel is further characterized in that at the first end of the panel the second connecting means is swaged to reduce its outer dimensions and a length of the first connecting means is cut away, whereby the panels may be erected in end-to-end overlapped relation and in side-by-side interlocked relation.

DESCRIPTION OF THE PREFERRED EMBODIMENT(S)

Figure 1:
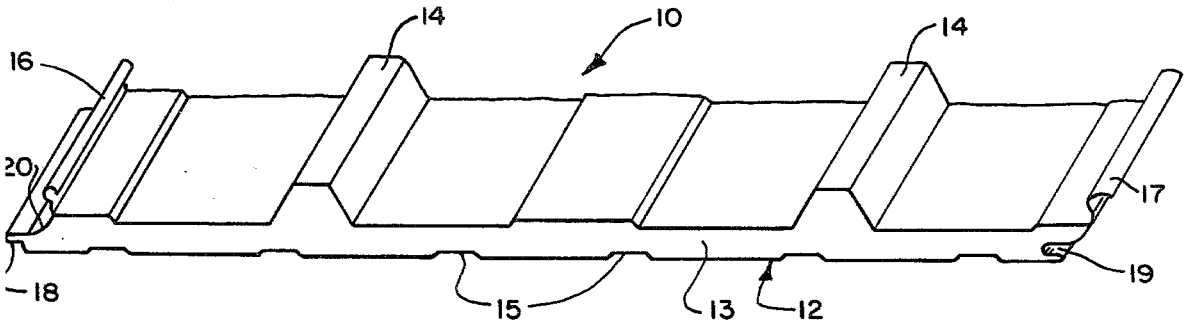
FIG. 1 is a fragmentary perspective view of the insulated roof panel according to this invention.

In general, the present roof panel 10, as illustrated in FIG. 1, comprises an outer skin 11, an inner skin 12, and an insulating core 13 connecting the outer skin 11 in shear-transferring relation to the inner skin 12. The outer and inner skins 11, 12 may be formed from sheet metal having a thickness of about 0.50 millimeter. The skins 11, 12 may have an embossed pattern and may have a decorative coating applied to the exterior surfaces thereof. The insulating core 13 may comprise any suitable insulating material. Preferably, the insulating core 13 comprises a foamed plastic material, such as polyurethane which is foamed-in-place between the skins 11, 12. To improve the span capabilities of the roof panel 10, the outer skin 11 may be provided with upstanding ribs 14. The remaining portions of the outer skin 11 may be profiled, as illustrated in FIG. 1. The inner skin 12 also may be provided with spaced depressions 15. The profiling of the skins 11, 12 helps eliminate waviness thereby improving the appearance of the exposed surfaces thereof.

First and second marginal connecting means 16, 17 are provided along the opposite longitudinal edges of the outer skin 11. First and second mating elements 18, 19 are provided along the opposite longitudinal edges of the inner skin 12. The outer skin 11 is laterally offset from the inner skin 12. The insulating core 13 presents an exposed core surface 20 in the region between the first connecting means 16 and the first mating element 18. The panel 10 is thereby adapted to be secured to a structural support by fastening means which penetrates the exposed core surface 20 and which is hidden from view.

Figure 2:
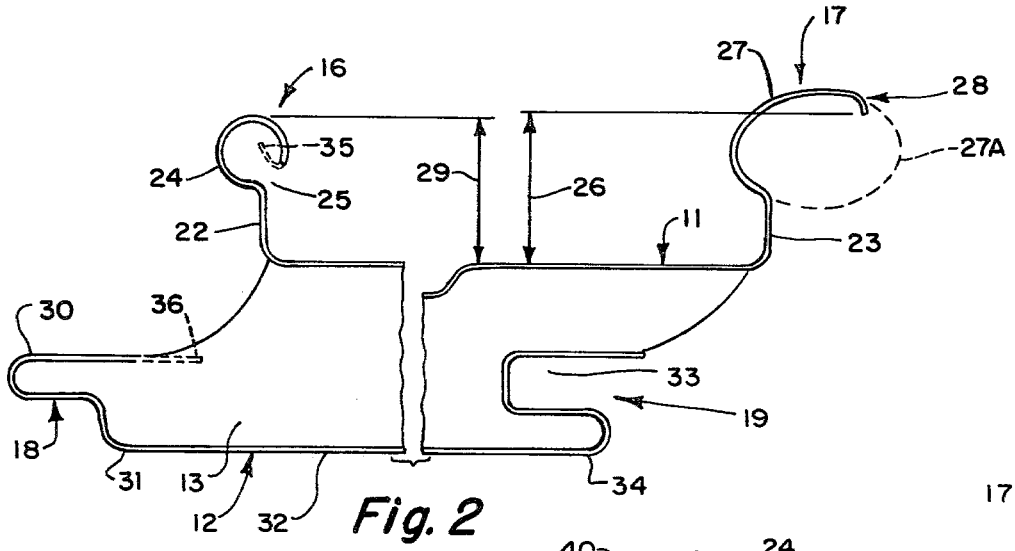
FIG. 2 is a broken end view of the roof panel of FIG. 1, illustrating the complementary mating elements and the marginal connecting means.

Referring to FIG. 2, the outer skin 11 includes a central outer web 21 having first and second upstanding sidewalls 22, 23 extending upwardly from the opposite longitudinal edges of the web 21. The first connecting means 16 comprises a generally tubular rib 24 formed along the upper edge of the first sidewall 22. The tubular rib 24 comprises an incomplete circle and presents a lengthwise opening 25 providing communication to the interior of the rib 24.

The second connecting means 17 comprises an arcuate open loop 27 having an elliptical-like transverse profile—an ellipse being shown for the purpose of illustration in dotted outline at 27A. The open loop 27 extends away from the central upper web 21 and includes an in-turned terminal portion 28 extending downwardly toward the plane of the outer web 21. To facilitate interconnecting adjacent panels 10 and to avoid unnecessary and undesirable flexing of the arcuate open loop 27, the in-turned terminal portion 28 is disposed at a level (height 26) above the level (height 29) of the tubular rib 24.

The arcuate open loop 27 is adapted to receive and to be bent about the tubular rib 24 of an adjacent panel thereby to provide a weathertight joint. When closing the loop 27 about the rib 24, no sharp bends are formed. Instead, the shape of the loop 27 is changed from its initial generally elliptical shape to a generally tubular shape corresponding to the shape of the rib 24. Hence, a decorative coating applied to the exterior surface of the outer skin 11 will not experience undesirable cracking and spalling as the loop 27 is closed. Because only minor bending stresses are encountered, the number of different types of decorative coating materials which can be applied to the skin 11 is significantly increased.

The first mating element 18 comprises a tongue 30 extending laterally outwardly of a longitudinal edge 31 of the central inner web 32. The second mating element 19 comprises a complementary groove 33 which extends laterally inwardly of the opposite longitudinal edge 34. The tongue 30 and the groove 33 extend generally parallel with the inner web 32 and reside between the plane of the outer web 21 and the plane of the inner web 32. When adjacent roof panels 10 are assembled in side-by-side relation, the tongue 30 of one panel is received within the groove 33 of the adjacent panel. The central inner webs 32 of the adjacent panels provide a flush interior surface.

The outer skin 11 and the inner skin 12 are formed from material having a selected girth. When manufacturing the roof panel 10, it is preferred that the shapes of the arcuate loop 27 and of the complementary groove 33 be held to that illustrated in FIG. 2. Consequently, should the material girth exceed the selected girth, the excess or run-out material appears, in the outer skin 11, as a flange illustrated in dotted outline at 35 which extends into the interior of the tubular rib 24; and appears, in the inner skin 12, as an extension illustrated in dotted outline at 36 of the tongue 30. The flange 35 does not interfere with the connection formed between the loop 27 and the rib 24; and the extension 36 does not interfere with the connection formed between the tongue 30 and a groove 33.

The opposite ends of the roof panel 10 may be adapted in a manner which facilitates erection of the roof panels 10 in end-to-end overlapped relation and in side-by-side interlocked relation.

Figure 3:
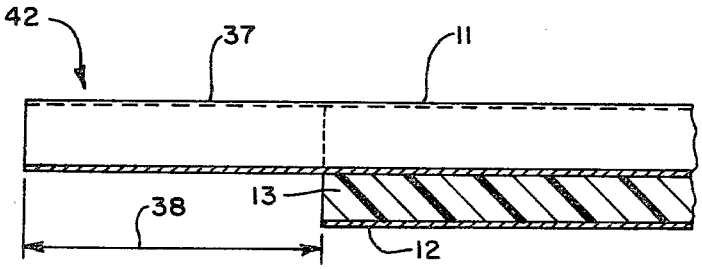
FIG. 3 is a fragmentary cross-sectional view, taken longitudinally of the roof panel of FIG. 1, illustrating the extension of the outer skin beyond the inner skin and the insulating core at one end of the roof panel.

At a first end 42 of the panel, as illustrated in FIG. 3, the outer skin 11 presents a lapping end 37 which extends beyond the inner skin 12 and the insulating core 13 for a distance 38.

Figure 4:
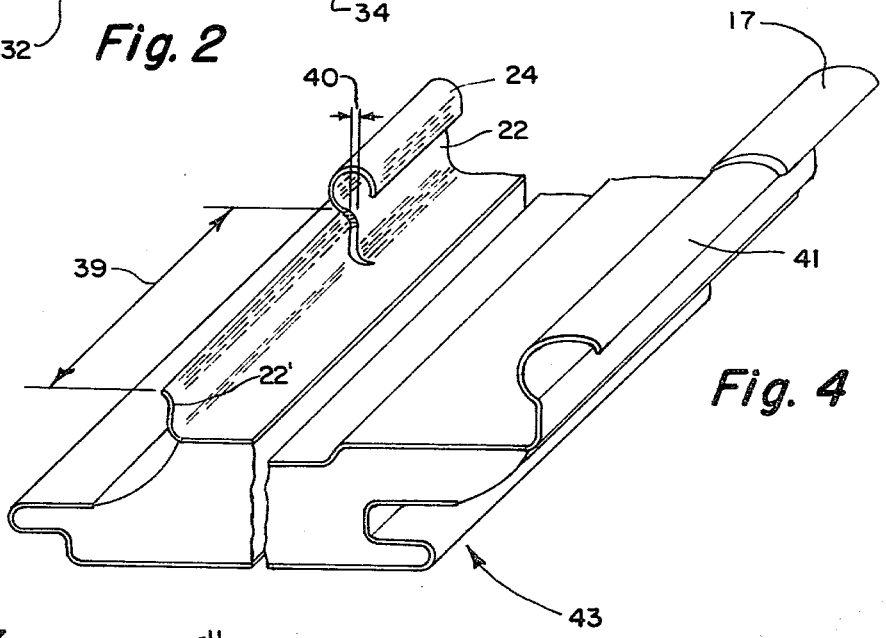
FIG. 4 is a broken fragmentary isometric view of the opposite end of the panel of FIG. 1 illustrating the marginal connecting means modified to permit the panels to be erected in end-to-end relation and in side-by-side relation.

At the opposite or second end 43 of the panel, as illustrated in FIG. 4, a segment having a length 39 of the generally tubular rib 24 is cut away and a corresponding length of the first sidewall indicated at 22' is outwardly offset from the sidewall 22 by at least one metal thickness as indicated at 40. Also, the arcuate loop 27 is swaged as at 41 to reduce the outer dimensions thereof. When the panels 10 are erected in end-to-end relation, the tubular rib 24 of the lapping end 37 serves as a continuation of the tubular rib 24, while the open loop 27 of the lapping end 37 overlies the swaged end 41.

We claim:

1. An insulating roof panel comprising an inner skin, an outer skin, and an insulating core securing the inner skin in shear-transferring relation to the outer skin; and said inner skin including a central inner web and complementary mating elements formed along the opposite longitudinal edges thereof; said outer skin including a central outer web having first and second upstanding sidewalls extending upwardly from the opposite longitudinal edges of said central outer web, and first and second marginal connecting means formed along the upper edges of said first and second sidewalls, one of said connecting means comprising a rib comprising a segment of a cylinder and having a lengthwise opening presented between a free edge of said rib and one of said upper edges, said lengthwise opening facing said central upper web, the other of said connecting means comprising an arcuate open loop extending away from said central outer web and having an in-turned terminal portion extending toward the plane of said central web and disposed at a level above said rib, said arcuate open loop being configured to receive the rib of an adjacent panel and to be bent about the free edge thereof thereby to provide a weathertight joint.

2. The roof panel of claim 1 wherein said arcuate loop has an elliptical transverse profile.

3. The roof panel of claim 1 wherein said outer skin is laterally offset relative to said inner skin, and said insulating core presents an exposed core surface in the region between said first sidewall of said outer skin and the adjacent mating element of said inner skin whereby the panel is adapted to be secured to a structural support by fastening means penetrating said exposed core surface.

4. The roof panel of claim 1 wherein one of said mating elements comprises a tongue extending laterally outwardly of one longitudinal edge and the other of said mating elements comprises a complementary groove extending laterally inwardly of the opposite longitudinal edge, the tongue and groove extending generally parallel with said inner web and residing between the plane of said outer web and the plane of said inner web.

5. The roof panel of claim 1 wherein at one end of said panel said arcuate open loop is swaged to reduce the outer dimension thereof.

6. The roof panel of claim 5 wherein at said one end of said panel, a length of said generally tubular rib is cut away and a corresponding length of said first sidewall is outwardlly offset by at least one skin thickness.

7. The roof panel of claim 1 wherein the inner and outer skins and the insulating core are conterminous at one end of said panel, and wherein at the opposite end of said panel said outer skin extends beyond said inner skin and said insulating core.

* * * * *